US010081051B2

(12) United States Patent
Roberts

(10) Patent No.: US 10,081,051 B2
(45) Date of Patent: Sep. 25, 2018

(54) VARIABLE METHOD FOR USING CLOTH FILTERS IN AUTOMATED VERTICAL MOLDING

(71) Applicant: Michael Roberts, Elkhorn, WI (US)

(72) Inventor: Michael Roberts, Elkhorn, WI (US)

( * ) Notice: Subject to any disclaimer, the term of this patent is extended or adjusted under 35 U.S.C. 154(b) by 0 days.

(21) Appl. No.: 15/952,417

(22) Filed: Apr. 13, 2018

(65) Prior Publication Data

US 2018/0229295 A1 Aug. 16, 2018

Related U.S. Application Data

(63) Continuation of application No. 14/686,906, filed on Apr. 15, 2015, now Pat. No. 9,968,992.

(51) Int. Cl.

| | |
|---|---|
| ***B29C 33/00*** | (2006.01) |
| ***B22C 9/08*** | (2006.01) |
| ***B22C 19/00*** | (2006.01) |
| ***B22C 23/00*** | (2006.01) |

(52) U.S. Cl.
CPC ..... *B22C 9/086* (2013.01); *B22C 19/00* (2013.01); *B22C 23/00* (2013.01)

(58) Field of Classification Search
CPC ..... B22C 9/086; B22C 19/00; B22C 23/00
See application file for complete search history.

(56) References Cited

U.S. PATENT DOCUMENTS

| | | | | |
|---|---|---|---|---|
| 4,007,923 | A * | 2/1977 | Chia | C22B 21/066 210/773 |
| 5,556,592 | A * | 9/1996 | Hitchings | B01D 29/096 164/134 |
| 6,224,818 | B1 * | 5/2001 | Hitchings | C21B 7/12 266/230 |
| 8,656,982 | B2 * | 2/2014 | Takashina | B22D 43/004 164/244 |
| 9,481,030 | B2 | 11/2016 | Roberts | |
| 2002/0088531 | A1 * | 7/2002 | Cook | B01D 29/012 156/160 |
| 2004/0231124 | A1 * | 11/2004 | Morimoto | B22D 11/005 29/419.1 |
| 2016/0221225 | A1 | 8/2016 | Roberts | |

* cited by examiner

*Primary Examiner* — Nahida Sultana
(74) *Attorney, Agent, or Firm* — Absolute Technology Law Group, LLC

(57) ABSTRACT

The present invention is a method for using cloth filters in automated vertical molding, comprised of the steps of configuring a modular cloth filter setter having a housing, an upper jaw, and a lower jaw, wherein the upper jaw and lower jaw are selected to correspond to the size of a cloth filter, fixedly attaching the housing of the modular cloth filter setter to a mechanical arm, securing the cloth filter between the upper jaw and the lower jaw, creating a sand mold from a quantity of compressed sand, creating at least one print aperture for insertion of a cloth filter, and placing the cloth filter in the print aperture.

20 Claims, 10 Drawing Sheets

VARIABLE METHOD FOR USING CLOTH FILTERS IN AUTOMATED VERTICAL MOLDING

CROSS-REFERENCE TO RELATED APPLICATIONS

This application is a continuation-in-part and claims the benefit of U.S. patent application Ser. No. 14/686,906 filed Apr. 15, 2015. The above application is incorporated by reference in its entirety herein.

FIELD OF INVENTION

This invention relates to the field of metal founding, and more specifically to system and method for utilizing a united particle type shaping surface.

BACKGROUND OF THE INVENTION

U.S. patent application Ser. No. 14/686,906 disclosed a system which enabled cloth filters to be properly positioned and manipulated for casting projects, and is incorporated by reference herein. Although this system works well, the problem remains in the art that castings may have undesirable metal protrusions. Additional steps have been identified through experimentation to address this issue.

Sand casting, also known as sand molded casting, is a metal casting process characterized by using sand as the mold material. The term "sand casting" can also refer to an object produced via the sand casting process. Specialized factories called foundries produce sand castings. Production of over 70% of all metal parts occurs via a sand casting process such as vertical molding processes.

High-volume foundries typically use vertical molding processes. Molds form a line allowing pouring of castings one after another. The process blows a molding sand mixture into a molding chamber using compressed air. The process then compresses the molding sand between patterned plates, each of which ultimately forms half of the pattern of the sand mold. Two sand molds pushed together form a complete internal sand cavity that receives the molten metal.

After compression, one of the chamber plates, a swing plate, swings open and the opposite plate, a ram plate, pushes the finished sand mold onto a conveyor. If desired, the process inserts cores into the sand cavity to form holes and recesses in the finished part. The cycle repeats until a chain of finished molds butt up to each other on the conveyor.

During this process, molten metal pours into sand cavities from a receptacle known in the art as a "pour cup" located on the top of each mold and positioned above a channel in the sand mold called the sprue. An automated device called a filter setter places the filter between the pour cup and the sprue inlet. The filter setter moves the filter into position and then injects the filter into the sand mold. The filter print is the area in the sand into which the filter inserts.

It is desirable to decrease the size of the filter print because the filter print and channels entirely fill with metal during the casting process. Metal left behind in the sprue, channels and filter print is excess metal, requiring removal from the part and repurposing.

It is a problem known in the art that repurposing metal recovered from the sprue, channels and filter print is very costly. An important component of a foundry's profitability is its ability to reduce the amount of repurposed metal and the effective "yield" of the metal that goes into the finished part. If a foundry is able to reduce the amount of metal recoverable from the sprue, channels and filter print by 10%, this could increase foundry yield by 2% to 5%.

There several problems associated with filters known in the art. Ceramic filters must be carefully primed or they fracture and introduce fragments in the casting. Ceramic filters are large, requiring correspondingly larger filter prints to hold them in place. Ceramic filters are also relatively expensive.

One solution is to replace ceramic filters with cloth or mesh filters. Cloth filters generally strain molten metal more quickly than ceramic filters. Previous attempts to use cloth filters failed because filter setters could not hold the cloth filters in place, filter setters could not insert the cloth filters properly, the filter coatings could not withstand metal temperatures or the cloth filters were not supported properly to withstand the downforce of the poured molten metal.

Furthermore, foundry workers, many wearing protective gear such as gloves, find difficulty in separating a single cloth filter from a stack for insertion into the filter setter. The patterned plates used to create the sand mold in the prior art are not capable of molding an insertion cavity allowing effective insertion of the cloth filter into the sand mold. Moreover, during pouring of the molten metal, inadequate mold support of the cloth filter can cause the filter to dislodge from the sand mold.

It is desirable to provide a foundry system optimized for using a cloth filter.

When castings cool and harden, they often have excess metal protrusions formed by the metal feed inlet channel. Air hammers, jaws, or heavy mallets can remove these protrusions from the casting, but this will often damage the casting.

Generally, the end of an inlet channel that is closest to the casting is significantly narrower than the rest of the channel, creating a weak spot in the excess metal protrusion to make it easier to remove from the casting. However, having a narrow section in the channel can block the flow of molten metal, especially when the casting is cooling.

There is an unmet need for an alternative method for intricate casting.

SUMMARY OF THE INVENTION

The invention is a method for using cloth filters in automated vertical molding. One exemplary embodiment is comprised of the steps of configuring a modular cloth filter setter having a housing, an upper jaw, and a lower jaw, wherein the upper jaw and lower jaw are selected to correspond to the size of a cloth filter, fixedly attaching the housing of the modular cloth filter setter to a mechanical arm, securing the cloth filter between the upper jaw and the lower jaw, creating a sand mold from a quantity of compressed sand, creating at least one print aperture for insertion of a cloth filter, and placing the cloth filter in the print aperture.

In another embodiment, a method for using cloth filters in automated vertical molding includes the step of inserting a cloth filter into a filter setter mounted to a mechanical arm. The method then compresses a quantity of sand with a ram plate having a mounted filter print plate to create at least part of a sand mold. The mounted filter print plate creates at least part of an aperture. Next, the method compresses the quantity of sand with a swing plate having a mounted filter back shelf to create at least part of the sand mold. The method then inserts the cloth filter into the sand mold using the filter setter mounted to the mechanical arm until three edges of the cloth filter rest within the filter print. Next, the method removes the filter setter and the mechanical arm to leave the cloth filter in the sand mold.

BRIEF DESCRIPTION OF SEVERAL VIEWS OF THE DRAWING(S)

FIGS. 1*a*-1*d* illustrate perspective, top, front and side views, respectively, of an exemplary embodiment of a filter separation box of a system for using cloth filters in automated vertical molding.

FIGS. 2*a*-2*d* illustrate perspective, top, front and side views, respectively, of an exemplary embodiment of a filter setter of a system for using cloth filters in automated vertical molding.

FIGS. 3*a*-3*e* illustrate perspective, top, front, side and mounted views, respectively, of an exemplary embodiment of a filter print plate of a system for using cloth filters in automated vertical molding.

FIGS. 4*a*-4*c* illustrate front, side and mounted views, respectively, of an exemplary embodiment of a filter back shelf plate of a system for using cloth filters in automated vertical molding.

TERMS OF ART

Figure 1A:
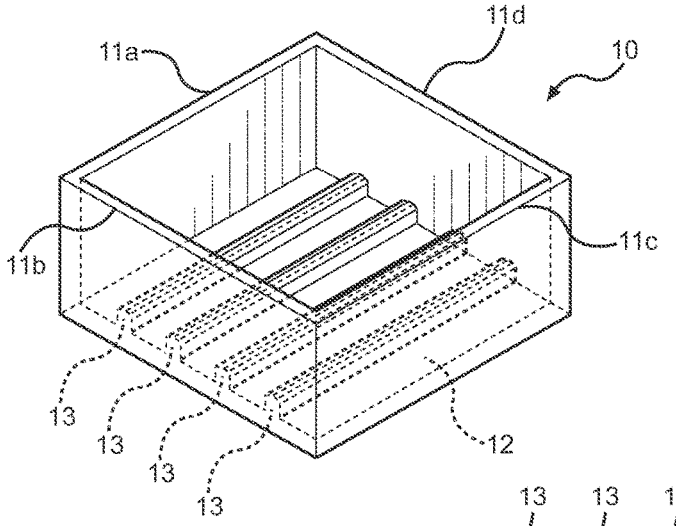
Figure 1B:
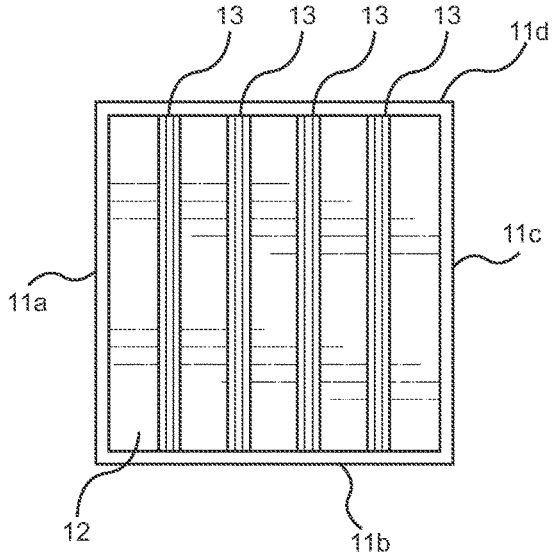
Figure 1C:
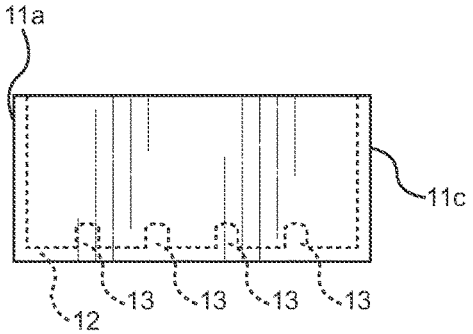
Figure 1D:
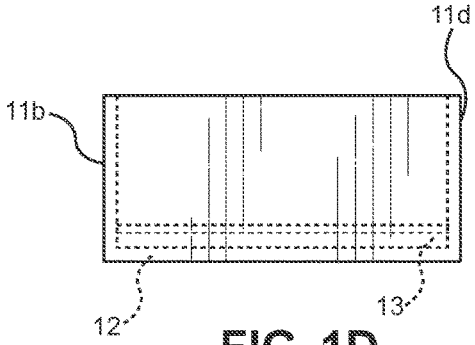
Figure 2A:
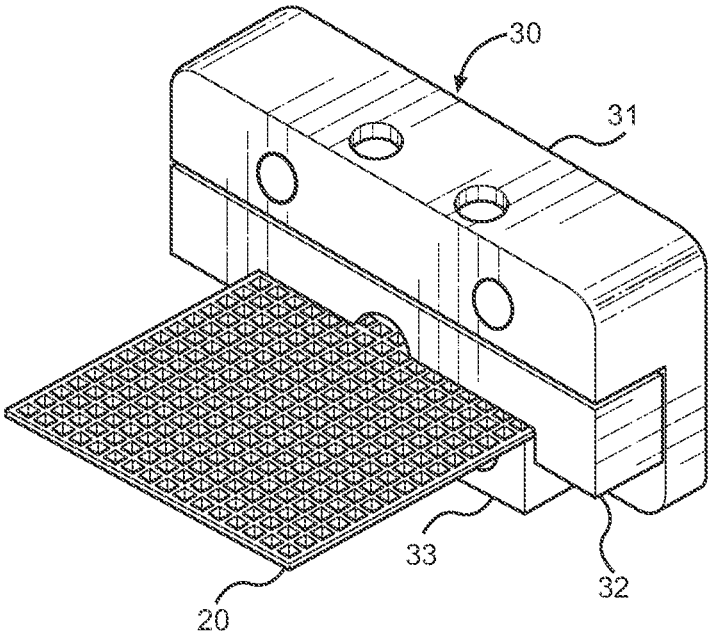
Figure 2B:
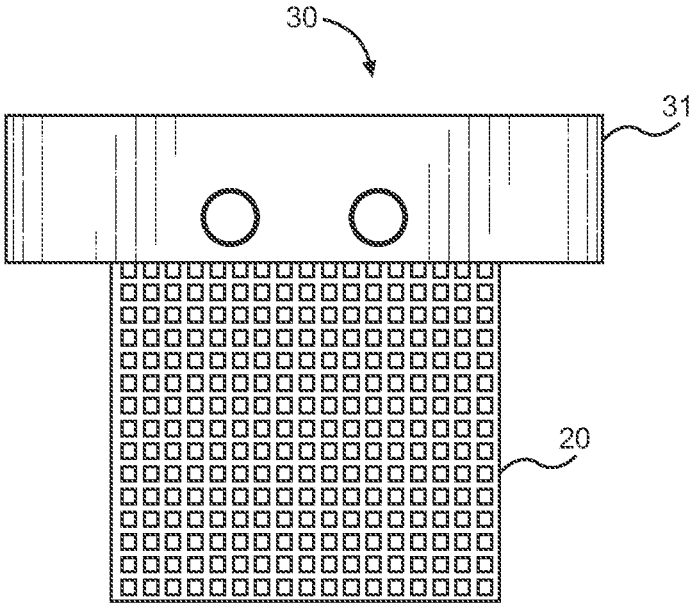
Figure 2C:
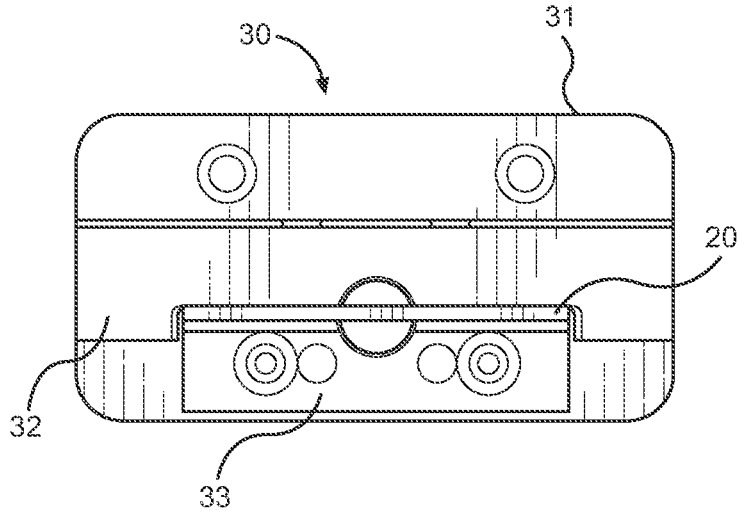
Figure 2D:
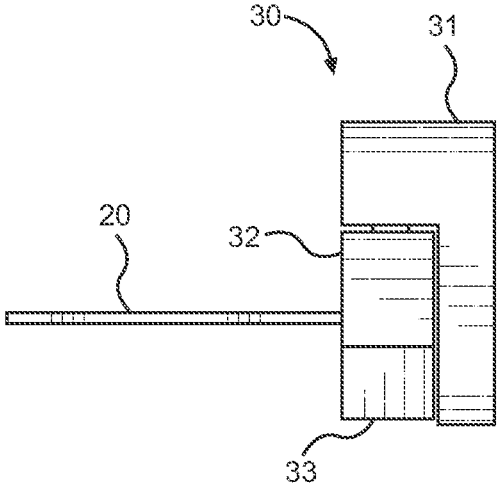

As used herein, the term "cloth filter" means a filter having an interlaced or woven structure.

As used herein, the term "side dimension" means a length or width of an object.

DETAILED DESCRIPTION OF THE INVENTION

FIGS. 1*a*-4*c* and FIG. 6 illustrate exemplary embodiments of a system 100 for using cloth filters 20 in automated vertical molding. System 100 includes an optional filter separation box 10, at least one cloth filter 20, a filter setter 30, a filter print plate 40 and a filter back shelf 50.

FIGS. 1*a*-1*d* illustrate perspective, top, front and side views, respectively, of an exemplary embodiment of filter separation box 10 of system 100 for using cloth filters 20 in automated vertical molding. Filter separation box 10 includes a plurality of walls 11*a*-11*d*, a base 12 and a plurality of separation structures 13. Walls 11*a*-11*d* surround and attach to base 12. Walls 11*a*-11*d* are approximately 6 to approximately 12 inches in height. Base 12 forms a square of approximately 12 inches to approximately 18 inches in length and width. Separation structures 13 are integrally formed with base 12, extending along base 12 between walls 11*b* and 11*d*, and may number between approximately 4 and approximately 10 depending on the size of the cloth filter 20. Separation structures 13 are approximately 0.5 inches to approximately 0.625 inches wide. The height of each separation structure 13 is no less than one-third the length of cloth filter 20. Separation structures 13 are spaced apart no more than two-thirds the length of cloth filter 20.

In the exemplary embodiment, the cross-section of separation structure 13 is a rounded rectangle. In other embodiments, the cross-section of separation structure 13 may be, but is not limited to, a rectangle, a square, a half-circle or a triangle. In certain embodiments using smaller filters, the cross-section of separation structure 13 may be more rounded shapes such as, but not limited to, an arc. Polygonal angles may be sharp or rounded. Separation structure 13 separates cloth filters 20 when stacked cloth filters 20 drop into filter separation box 10, allowing operators to easily remove a single cloth filter 20.

FIGS. 2*a*-2*d* illustrate perspective, top, front and side views, respectively, of an exemplary embodiment of filter setter 30 of system 100 for using cloth filters 20 in automated vertical molding. Filter setter 30 comprises, in part, a housing 31, at least one upper jaw 32 and at least one lower jaw 33. Housing 31 removably mounts to a mechanical arm A. A width of upper jaw 32 is approximately equal to or less than a width of housing 31. A width of lower jaw 33 is approximately equal to or greater than a width of cloth filter 20. In certain embodiments, system 100 includes a plurality of removably attachable upper jaws 32 and a plurality of removably attachable lower jaws 33. This allows upper jaws 32 and lower jaws 33 to be "swapped out" to accommodate cloth filters 20 having different widths.

Filter setter 30 holds a single cloth filter 20 between upper jaw 32 and lower jaw 33 as mechanical arm A travels to the point of filter insertion into a sand mold M. After cloth filter 20 is inserted into a filter cavity formed by a filter print plate 40, an ejection mechanism discharges cloth filter 20 from filter setter 30, leaving cloth filter 30 in sand mold M. Filter setter 30 is fully described in U.S. patent application Ser. No. 14/610,967 filed Jan. 30, 2015, hereby incorporated by reference in its entirety.

FIGS. 3*a*-3*e* illustrate perspective, top, front, side and mounted views, respectively, of an exemplary embodiment of filter print plate 40 of system 100 for using cloth filters 20 in automated vertical molding. Filter print plate 40 mounts to a ram plate R that presses filter print plate 40 into sand mold S to create a cavity into which cloth filter 20 is inserted. Filter print plate 40 creates a cavity high enough to allow an unobstructed insertion of cloth filter 20, but low enough to allow cloth filter 20 to contact the sand during the pouring of molten metal. Foundry plank F at least partially surrounds filter print plate 40 to create an aperture in sand mold M.

Filter print plate 40 has a minimum thickness no less than the thickness of cloth filter 20, and a maximum thickness no greater than twice thickness of cloth filter 20. The side of filter print plate 40 closest to ram plate R is approximately 2-6 mm wider than cloth filter 20. The cavity created by filter print plate 40 is wider than cloth filter 20 to account for insertion of cloth filter 20 into filter setter 30 at oblique angles. Additionally, the cavity created by filter print plate 40 may taper to enable removal of filter print plate 40 without damaging sand mold M. The opening to the cavity may be tapered or chamfered to allow insertion of a warped cloth filter 20.

Figure 3A:
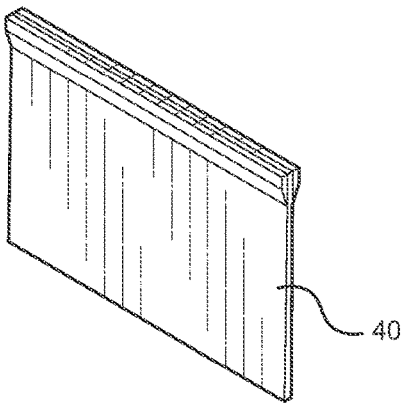
Figure 3B:
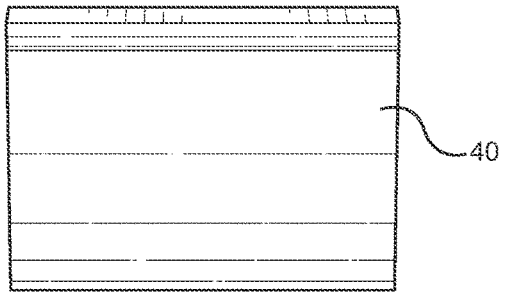
Figure 3C:
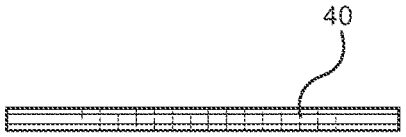
Figure 3D:
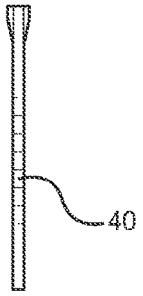
Figure 3E:
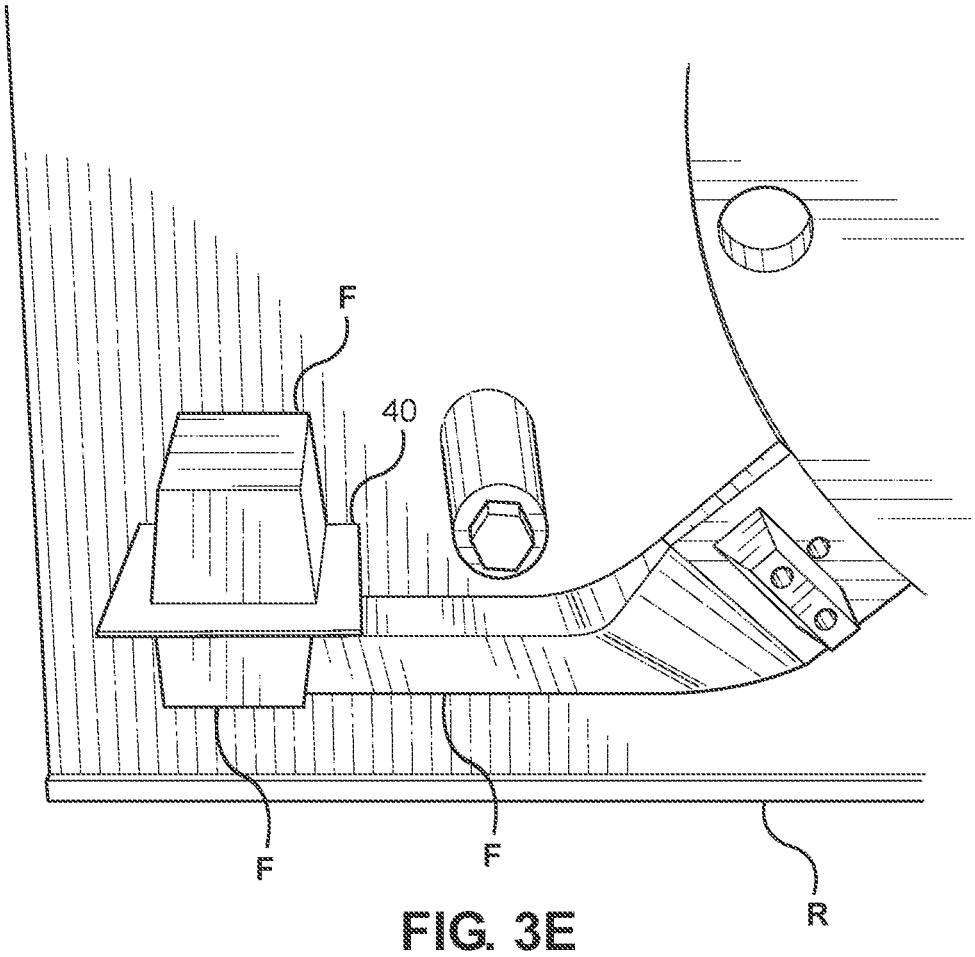

FIG. 3*e* shows filter print plate 40 mounted to ram plate R during the founding process. Foundry plank F at least partially surrounds filter print plate 40 to create an aperture in sand mold M.

Figure 4A:
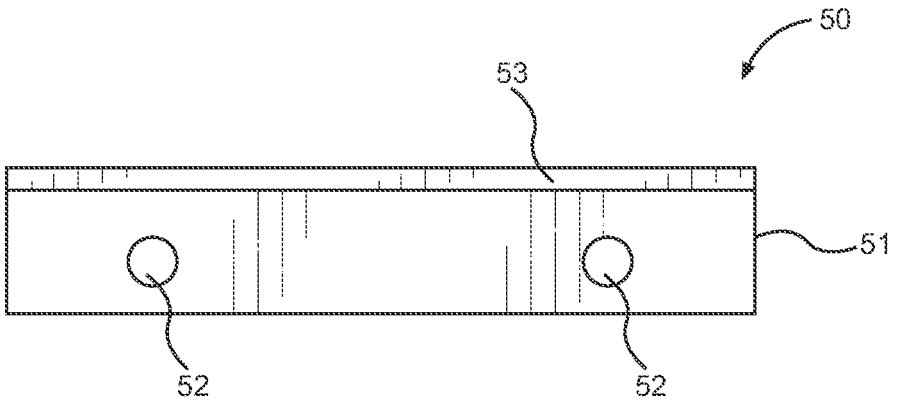
Figure 4B:
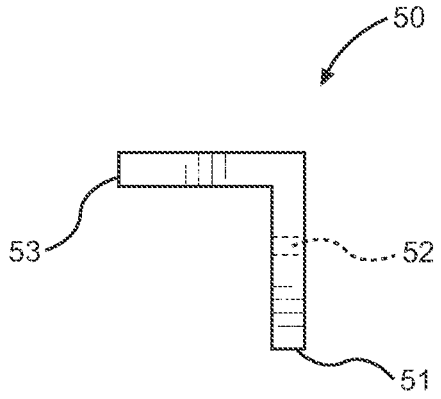
Figure 4C:
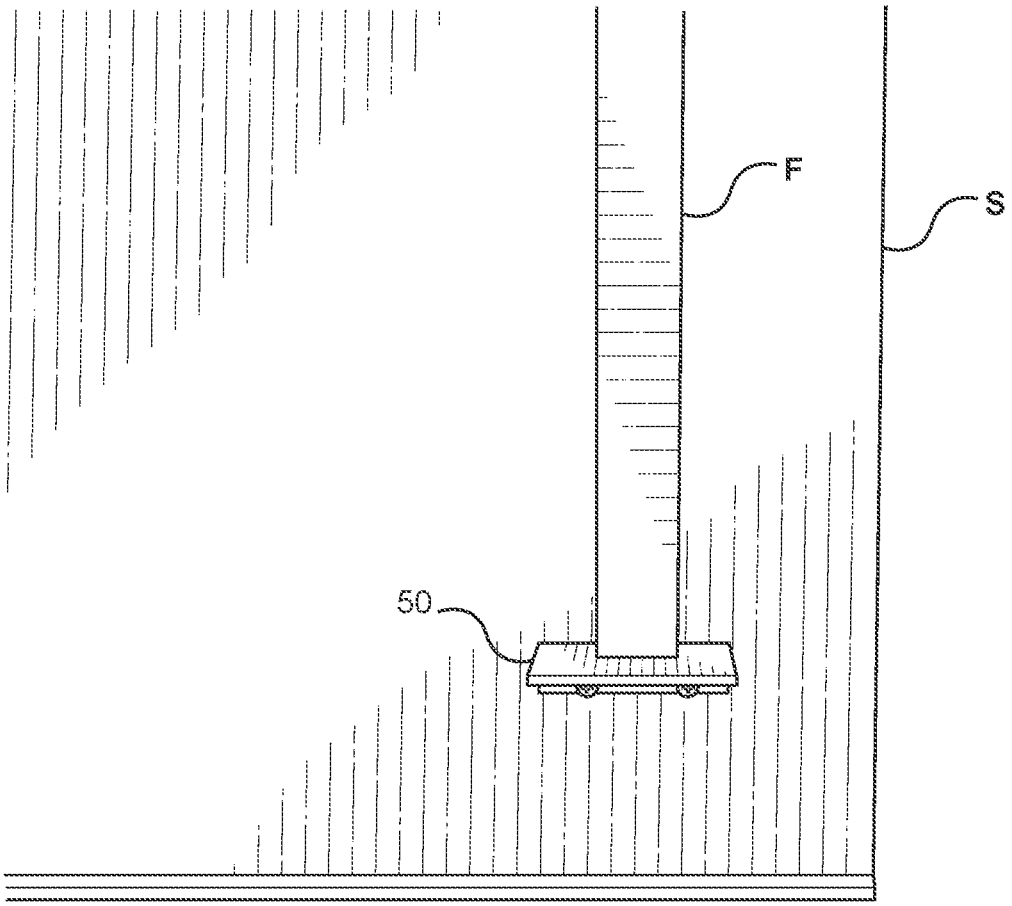

FIGS. 4*a*-4*c* illustrate front, side and mounted views, respectively, of an exemplary embodiment of filter back shelf plate 50 of system 100 for using cloth filters 20 in automated vertical molding. Filter back shelf plate 50 mounts to swing plate S to create a shelf aperture in sand mold M providing additional support for cloth filter 20 after insertion. Filter back shelf plate 50 has a cross-section of an L-shape rotated 90 degrees clockwise.

In the exemplary embodiment, first shelf leg 51 of filter back shelf plate 50 includes a plurality of attachment apertures 52 holding mechanical fasteners that removably mount filter back shelf plate 50 to swing plate S. Second shelf leg 53 has a length ranging from approximately 0.5 inches to approximately 1 inch. Second shelf leg 53 has a width ranging from the side dimension of cloth filter 20 to the side dimension of filter print plate 40. In certain embodiments, attachment apertures 52 are located on second shelf leg 53. In certain embodiments, first shelf leg 51 is longer than second shelf leg 53. In certain embodiments, at least one of first shelf leg 51 or second shelf leg 53 tapers.

FIG. 4*c* shows filter back shelf plate 50 mounted to swing plate S during the founding process. Foundry plank F at least partially surrounds filter back shelf plate 50 to create an aperture in sand mold M.

Figure 5:
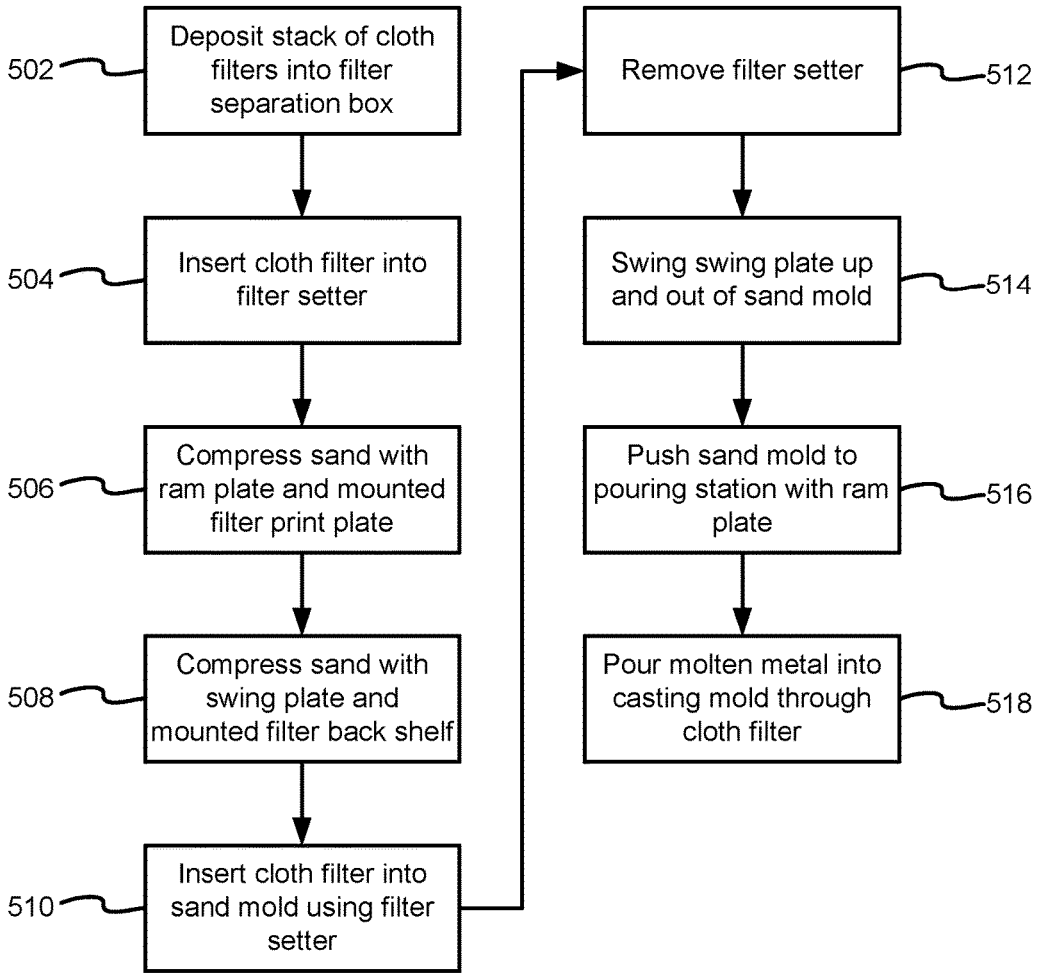
FIG. 5 illustrates a flowchart of an exemplary embodiment of a method for using cloth filters in automated vertical molding.

FIG. 5 illustrates a flowchart of an exemplary embodiment of a method 500 for using cloth filters 20 in automated vertical molding.

In optional step 502, method 500 deposits a stack of cloth filters 20 into filter separation box 10 to disarrange cloth filters 20 and make them easier to individually remove.

In step 504, method 500 inserts a cloth filter 20 into filter setter 30 mounted to a mechanical arm A.

In step 506, ram plate R with mounted filter print plate 40 compresses sand to create sand mold M. Filter print plate 40 creates at least part of a print aperture in sand mold M, within which three edges of cloth filter 20 rest.

In step 508, swing plate S with mounted filter back shelf 50 compresses sand to create sand mold M. Filter back shelf 50 creates a shelf aperture in sand mold M, within which a fourth edge of cloth filter 20 rests. Method 500 may perform steps 506 and 508 substantially simultaneously.

In step 510, mechanical arm A inserts cloth filter 20 into sand mold M using filter setter 30 until an edge of cloth filter 20 rests in the print aperture. In certain embodiments, an ejection cylinder ejects cloth filter 20 into sand mold M.

In step 512, mechanical arm A removes filter setter 30, leaving cloth filter 20 in sand mold M.

In step 514, swing plate S with a mounted filter back shelf 50 swings up and out of sand mold M.

In step 516, ram plate R with mounted filter print plate 40 pushes sand mold M to a pouring station P, where it abuts another sand mold M. Each sand mold M makes up one half of a casting mold C. Therefore, a single cloth filter 20 will rest in a filter print of a first sand mold M and in a shelf aperture of a second sand mold M.

In step 518, pouring station P pours molten metal into casting mold C through cloth filter 20 to create a cast part.

Figure 6:
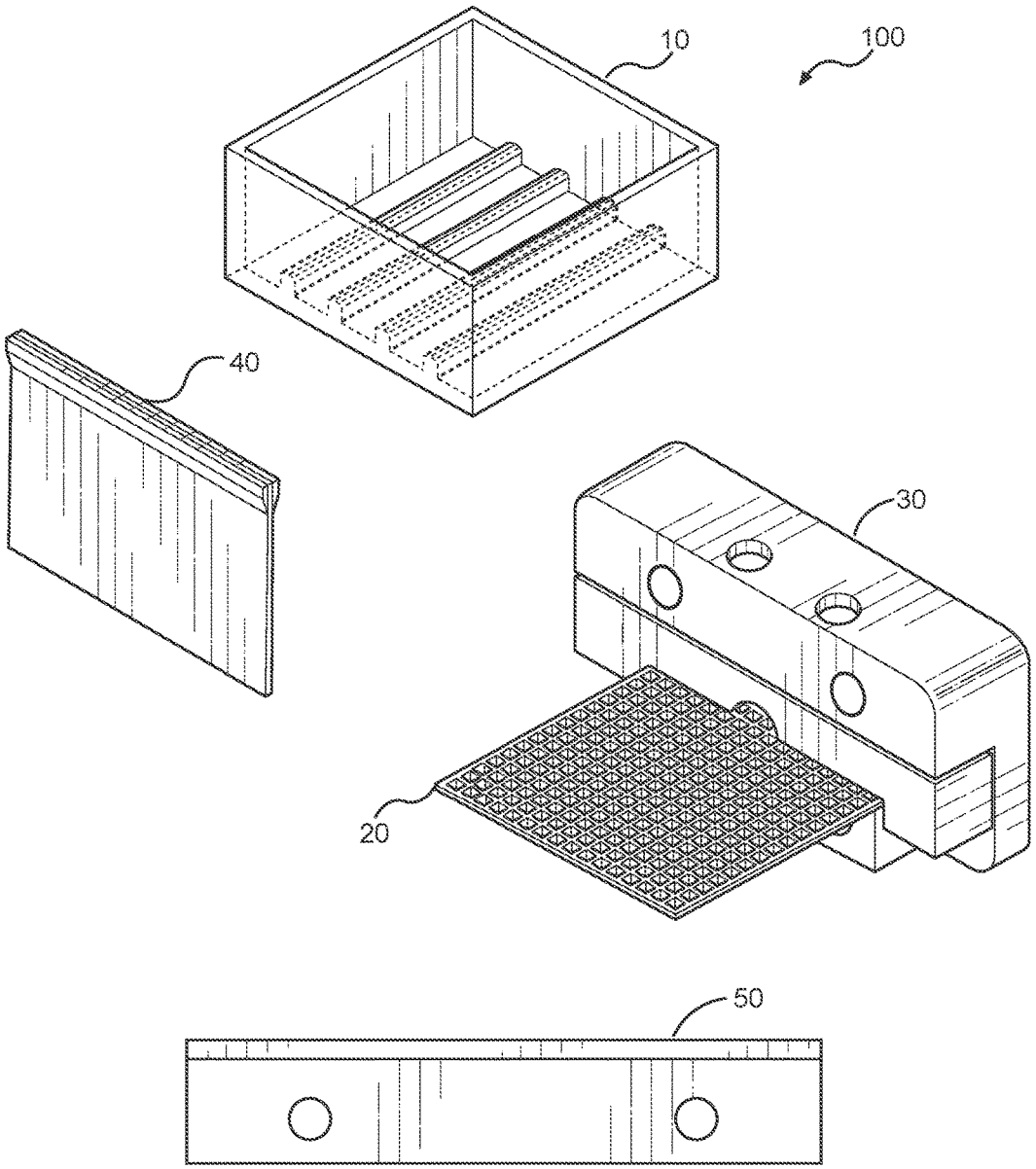
FIG. 6 illustrates a perspective view of an exemplary embodiment of a system for using cloth filters in automated vertical molding.

FIG. 6 illustrates a perspective view of an exemplary embodiment of a system 100 for using cloth filters 20 in automated vertical molding.

Figure 7:
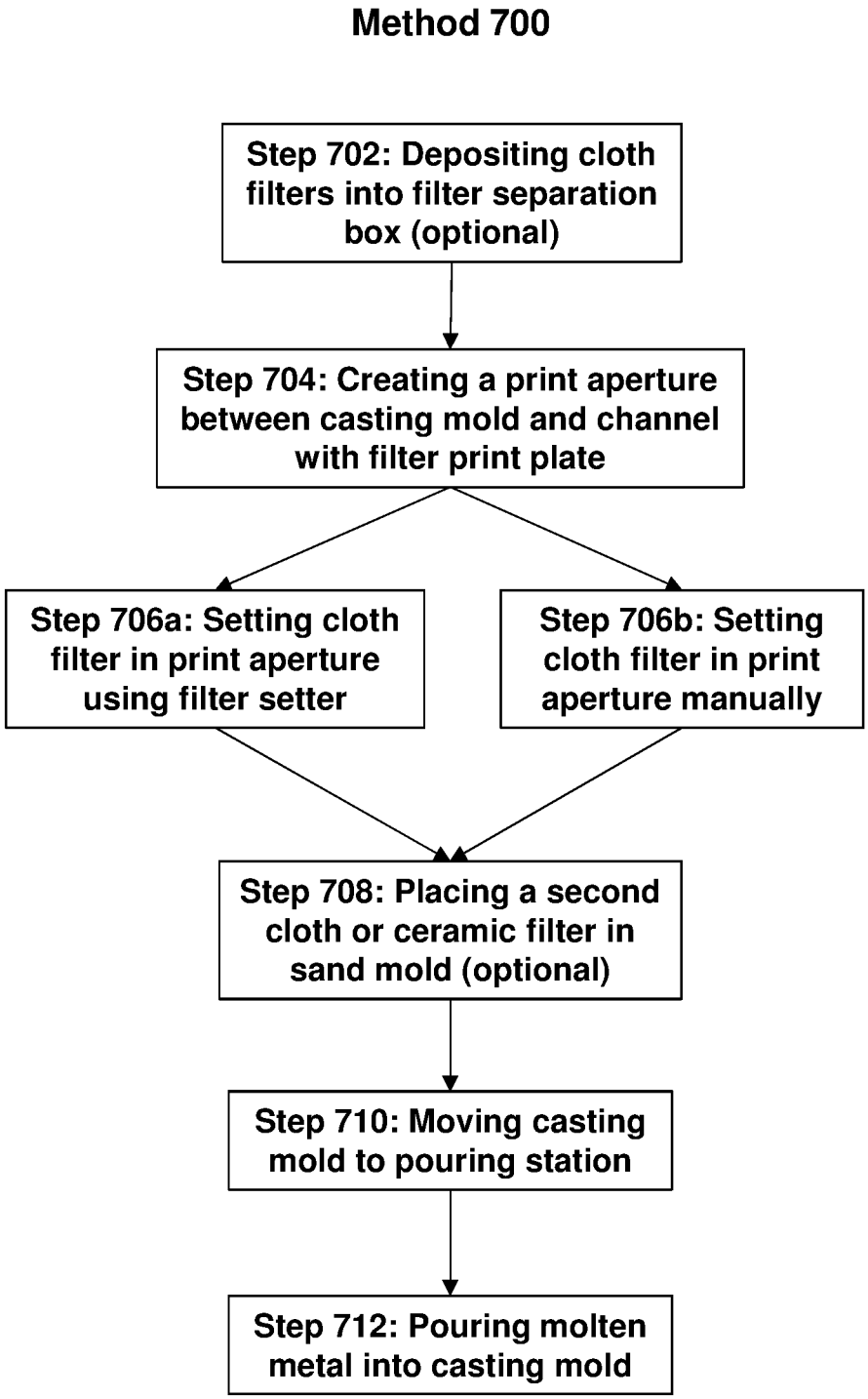
FIG. 7 illustrates a flowchart of an exemplary embodiment of a method for using cloth filters in intricate casting.

FIG. 7 illustrates a flowchart of an exemplary embodiment of a method 700 for using cloth filters 20 in intricate casting.

In optional step 702, method 700 deposits a stack of cloth filters 20 into filter separation box 10 to disarrange cloth filters 20 and make them easier to individually remove.

In step 704, ram plate R with mounted filter print plate 40 compresses sand to create a print aperture between casting mold C and the inlet channel through which molten metal will enter casting mold C. Filter print plate 40 creates at least part of a print aperture in casting mold C, within which three edges of cloth filter 20 rest.

In step 706*a*, method 700 filter setter 30 inserts cloth filter 20 into the print aperture between casting mold C and the inlet channel.

In certain embodiments, step 706*a* includes inserting cloth filter 20 into filter setter 30 mounted to a mechanical arm A, then mechanical arm A inserts cloth filter 20 into the print aperture using filter setter 30 until an edge of cloth filter 20 rests in the print aperture, then mechanical arm A removes filter setter 30, leaving cloth filter 20 in the print aperture. In certain embodiments, an ejection cylinder ejects cloth filter 20 into the print aperture.

In alternative step 706*b*, method 700 manually inserts cloth filter 20 into the print aperture between casting mold C and inlet channel.

Cloth filter 20 will create a barrier that diverts molten metal, creating an area of low-density metal in any metal protrusions that form in the inlet channel, proximal to the casting, as the metal cools and hardens.

In optional step 708, method 700 places a ceramic filter or a second cloth filter in sand mold M. The second cloth filter is placed as described in method 500.

In step 710, ram plate R with mounted filter print plate 40 pushes casting mold C to a pouring station P.

In step 712, pouring station P pours molten metal into casting mold C through cloth filter 20 to create a cast part.

In method 700, cloth filter 20 is positioned at the plane between an inlet metal feed channel and casting mold C before molten metal enters casting mold C. This positioning of cloth filter 20 creates a weak point made of an area of low-density metal called a shear plane in the metal protrusion that forms in the inlet metal feed channel while the cast part cools. Excess metal protrusions with shear planes are easier to remove without damaging the casting. Furthermore, the inlet metal feed channel will not need to have a narrow section proximal to the casting, thus the wide inlet metal feed channel will maintain a high flow rate of molten metal into the cast. In this embodiment, cloth filter 20 is also in position to filter the molten metal as it enters casting mold C and may be used with or without an optional second cloth filter 20 or ceramic filter inserted into sand mold M.

In various embodiments, method 700 measures parameters including time, volume, and pressure to assist in controlling the flow of molten metal into casting mold C.

What is claimed is:

1. A method for using cloth filters in automated vertical molding, comprised of the steps of:

configuring a modular cloth filter setter having a housing, an upper jaw, and a lower jaw, wherein said upper jaw and said lower jaw are selected to correspond to the size of a cloth filter;

fixedly attaching said housing of said modular cloth filter setter to a mechanical arm;

securing said cloth filter between said upper jaw and said lower jaw;

creating a sand mold from a quantity of compressed sand;

creating at least one print aperture for insertion of the cloth filter; and placing said cloth filter in said at least one print aperture.

2. The method of claim 1, wherein said at least one print aperture is located in said sand mold.

3. The method of claim 1, wherein said at least one print aperture is located between said sand mold and an inlet channel.

4. The method of claim 3, which further includes the step of diverting molten metal using said cloth filter.

5. The method of claim 4, which further includes the step of creating a barrier to form an area of low-density metal, using said cloth filter.

6. The method of claim 5, which further includes the step of forming a shear plane from said area of low-density metal, using said cloth filter.

7. The method of claim 1, which further includes the step of creating a second print aperture, wherein said second print aperture is located in said sand mold and wherein said at least one print aperture is located between said sand mold and an inlet channel.

8. The method of claim 7, which further includes the step of performing a filtering function using a filter located in said second print aperture.

9. The method of claim 7, which further includes the step of placing a ceramic filter in said second print aperture.

10. The method of claim 7, which further includes the step of placing a second cloth filter in said second print aperture.

11. The method of claim 7, which further includes the step of diverting molten metal using a cloth filter placed in said at least one print aperture.

12. The method of claim 11, which further includes the step of creating a barrier to form an area of low-density metal, using said cloth filter.

13. The method of claim 12, which further includes the step of creating a shear plane from said area of lower density metal, using said cloth filter.

14. The method of claim 1, which further includes the step of measuring a parameter selected from a group consisting of the following: time, volume, and pressure.

15. The method of claim 1, wherein said step of configuring said modular cloth filter setter further includes the step of replacing a first upper jaw and a first lower jaw with a second upper jaw and a second lower jaw.

16. The method of claim 15, wherein said second upper jaw and said second lower jaw have a size corresponding to the size of a newly selected cloth filter to be used.

17. The method of claim 1, which further includes the step of depositing a plurality of cloth filters into a filter separation box to disarrange said plurality of cloth filters and make said plurality of cloth filters easier to handle.

18. The method of claim 17, wherein said filter separation box includes a plurality of walls and a plurality of separation structures for disarranging said plurality of cloth filters and making said plurality of cloth filters easier to handle.

19. The method of claim 1, wherein said steps of creating at least one sand mold and creating at least one print aperture are performed substantially simultaneously.

20. The method of claim 1, which further includes the step of ejecting said cloth filter into said at least one print aperture with an ejection cylinder.

* * * * *